US010186092B2

(12) United States Patent
Lee et al.

(10) Patent No.: US 10,186,092 B2
(45) Date of Patent: Jan. 22, 2019

(54) SYSTEM AND METHOD FOR CONTROLLING, BY ENGINE CONTROL UNIT, FAULT CODE

(71) Applicant: HYUNDAI AUTRON CO., LTD., Seongnam-si (KR)

(72) Inventors: Tae-Kyoung Lee, Suwon-si (KR); Dae-Hyun Kim, Seoul (KR)

(73) Assignee: HYUNDAI AUTRON CO., LTD., Seongnam-si (KR)

( * ) Notice: Subject to any disclaimer, the term of this patent is extended or adjusted under 35 U.S.C. 154(b) by 0 days.

(21) Appl. No.: 14/965,696

(22) Filed: Dec. 10, 2015

(65) Prior Publication Data

US 2016/0335818 A1 Nov. 17, 2016

(30) Foreign Application Priority Data

May 13, 2015 (KR) ..... 10-2015-0066842

(51) Int. Cl.
*G07C 5/08* (2006.01)

(52) U.S. Cl.
CPC ..... *G07C 5/085* (2013.01); *G07C 5/0808* (2013.01); *G07C 2205/02* (2013.01)

(58) Field of Classification Search
CPC ..... G07C 5/085; G07C 5/0808
See application file for complete search history.

(56) References Cited

U.S. PATENT DOCUMENTS 4,554,661 A * 11/1985 Bannister ..... G06F 11/0781 714/45
5,408,412 A * 4/1995 Hogg ..... G01M 15/05 701/29.1
5,983,381 A * 11/1999 Chakradhar ... G01R 31/318307 714/720
6,449,539 B1 * 9/2002 Ohno ..... G05B 23/0229 340/439
2005/0114087 A1 * 5/2005 Hofmeister ..... F02D 41/22 702/185
2005/0134284 A1 * 6/2005 Hoff ..... G05B 23/0256 324/511
2010/0138817 A1 * 6/2010 Dubinsky ..... G06F 11/3644 717/148
2014/0067231 A1 * 3/2014 Mosher ..... F02D 28/00 701/102
2014/0075356 A1 * 3/2014 Gray ..... G07O 5/008 715/771

(Continued)

FOREIGN PATENT DOCUMENTS

CN 201501218 Y 4/2008
CN 103279124 A 9/2013

(Continued)

*Primary Examiner* — Jess Whittington
(74) *Attorney, Agent, or Firm* — Morgan, Lewis & Bockius LLP

(57) ABSTRACT

A system and method for controlling, by an engine control unit, fault code, may include an engine control unit configured to have pieces of fault code classified according to the components of an engine or sensors for sending data to the engine and defined in the engine control unit as a plurality of groups and a tester configured to send activation/deactivation commands to one or more groups for the pieces of fault code defined in the engine control unit.

4 Claims, 11 Drawing Sheets

(56) References Cited

U.S. PATENT DOCUMENTS

| | | | | |
|---|---|---|---|---|
| 2014/0282256 | A1* | 9/2014 | Fish | G06F 3/04886 715/835 |
| 2015/0039176 | A1* | 2/2015 | Fish | G07O 5/008 701/31.6 |
| 2015/0134192 | A1* | 5/2015 | Kakinuma | G07C 5/008 701/31.4 |
| 2016/0280231 | A1* | 9/2016 | Winblad Von Valter | B60W 50/0205 |

FOREIGN PATENT DOCUMENTS

| | | | |
|---|---|---|---|
| JP | 7-62460 | B2 | 7/1995 |
| KR | 10-0501288 | B1 | 7/2005 |
| KR | 10-2010-0073227 | A | 7/2010 |
| KR | 10-2014-0071719 | A | 6/2014 |

* cited by examiner

FIG. 11

| Component | Fault code group | EOL test |
|---|---|---|
| Input speed sensor | Group 1 | Deactivation |
| Input analog sensor | Group 2 | Deactivation |
| Solenoid group | Group 3 | Activation |
| Solenoid supply power | Group 4 | Activation |
| Internal core | Group 5 | Deactivation |
| Communication | Group 6 | Deactivation |
| ... | Group n(n is positive integer) | ... |

SYSTEM AND METHOD FOR CONTROLLING, BY ENGINE CONTROL UNIT, FAULT CODE

CROSS REFERENCE TO RELATED APPLICATION

The present application claims the benefit of Korean Patent Application No. 10-2015-0066842 filed in the Korean Intellectual Property Office on May 13, 2015, the entire contents of which are incorporated herein by reference.

BACKGROUND OF THE INVENTION

1. Technical Field

The present invention relates to a system and method for controlling, by an engine control unit (hereinafter referred to as an "ECU"), fault code and, more particularly, to a system and method for controlling, by an ECU, fault code in which pieces of fault code are classified according to the components of an engine or the components of sensors for sending data to the engine and defined as a plurality of groups.

2. Description of the Related Art

As the car electronics industry is accelerated, various electronic control units related to safety are mounted on a vehicle. An ECU of the electronic control units is responsible for control of the driving of an engine, that is, the most salient part of the vehicle and controls the overall state of the engine based on data transmitted by various sensors. Accordingly, whether the ECU has failed or not is the most important factor in the safety of the vehicle.

An ECU produced in a factory has a possibility that it may break down in the state in which it has been mounted on the vehicle. In particular, an output stage having a good possibility of a failure needs to be certainly tested before it is released and to be released. Accordingly, before a vehicle is released, a test for checking whether all the input stages and output stage of the ECU normally operate by performing a fault diagnosis and preventing the failure of the ECU which may occur while driving and also securing initial quality by artificially applying a specific condition and stress needs to be performed, which is called an aging test.

In such an aging test, a fault diagnosis of other components other than a component to be tested needs to be prohibited. In this case, there are problems in that dedicated software for the aging test must be developed and installed in the ECU, an engine control program must be reprogrammed after the aging test is performed, and the vehicle must be released. That is, there are problems in that efficiency of production is deteriorated because the fabrication period of the vehicle is increased due to the additional reprogramming process, the process becomes complicated, and a defect occurrence probability is increased because an error is generated in the reprogramming process.

Accordingly, the present invention proposes a new and advanced system and method for controlling, by an ECU, fault code, which does not require the development and installation of dedicated software for performing an aging test and does not require an additional reprogramming process.

PRIOR ART DOCUMENT

Patent Document (Patent Document 0001) Korean Patent Application Publication No. 10-2014-0071719 (Jun. 12, 2014)

SUMMARY OF THE INVENTION

An object of the present invention is to provide a system and method for controlling, by an ECU, fault code, which does not require the development and installation of dedicated software for performing an aging test.

Another object of the present invention is to provide a system and method for controlling, by an ECU, fault code, which does not require an additional reprogramming process after an aging test is performed.

Technical objects to be achieved by the present invention are not limited to the objects, and various technical objects may be derived within a range evident to those skilled in the art from the following description.

An engine control unit in accordance with an embodiment of the present invention includes a fault code definition unit configured to have pieces of fault code defined in the fault code definition unit, a fault code control unit configured to control the activation/deactivation of the pieces of fault code defined in the fault code definition unit, a fault code storage unit configured to store fault code detected by performing a test, and a fault code output unit configured to output the fault code stored in the fault code storage unit.

Furthermore, the pieces of fault code may have been classified according to the components of an engine or sensors for sending data to the engine and defined in the fault code definition unit as a plurality of groups. The fault code control unit may include a fault code activation/deactivation unit configured to activate one or more of the plurality of groups defined in the fault code definition unit and deactivating remaining groups and a monitoring unit configured to monitor the one or more groups activated by the fault code activation/deactivation unit at a specific time interval.

Furthermore, the one or more groups activated by the fault code activation/deactivation unit may include groups in which fault code for a component which requires a test may have been defined. The remaining groups deactivated by the fault code activation/deactivation unit may include groups in which fault code for a component which does not require a test has been defined.

Furthermore, the engine control unit may include a communication unit configured to communicate with a tester. The communication unit may receive fault code activation/deactivation commands from the tester, may send the fault code activation/deactivation commands to the fault code control unit, may receive a fault code output command from the tester, and may send the fault code output command to the fault code output unit.

A system for controlling, by an engine control unit, fault code in accordance with an embodiment of the present invention includes an engine control unit configured to have pieces of fault code classified according to the components of an engine or sensors for sending data to the engine and defined in the engine control unit as a plurality of groups and a tester configured to send activation/deactivation commands to one or more groups for the pieces of fault code defined in the engine control unit. In accordance with an embodiment of the present invention, an aging test can be conveniently performed because the fabrication and installation of dedicated software for performing the aging test are not required. Furthermore, an additional reprogramming process is not required after an aging test. Accordingly, the fabrication period of a vehicle can be reduced, efficiency of production can be improved, the process can be simplified, and a probability that an error may occur in an additional reprogramming process can be significantly reduced.

Furthermore, the deactivation command may be transmitted to a group in which fault code for a component which does not require a test has been defined. The engine control unit may include a communication unit configured to communicate with the tester. The communication unit may receive a fault code activation/deactivation command from the tester and send the fault code activation/deactivation command to a fault code control unit. The engine control unit may further include a fault code storage unit configured to store fault code detected by performing a test.

In accordance with an embodiment of the present invention, a method for controlling, by an engine control unit, fault code in the engine control unit in which pieces of fault code may be classified according to the components of an engine or sensors for sending data to the engine and may be defined as a plurality of groups includes the steps of (a) sending, by a tester, a deactivation command for one or more groups to a fault code control unit through a communication unit, (b) deactivating, by the fault code control unit, the one or more groups, (c) performing, by a fault code definition unit, a test, and (d) storing, by a fault code storage unit, detected fault code if, as a result of the test, the fault code is detected. Accordingly, the same effects as the system for controlling, by an engine control unit, fault code can be derived.

Furthermore, the deactivation command may be transmitted to a group in which fault code for a component which does not require a test has been defined. The method may further include the steps of (e) sending, by the tester, an output command for the detected fault code to a fault code output unit through the communication unit and (f) loading, by the fault code output unit, the fault code stored in the fault code storage unit and sending the loaded fault code to the tester through the communication unit, after the step (d). The method may further include the step of (g) sending, by the tester, an activation command to the one or more groups to which the deactivation command has been transmitted to the fault code control unit through the communication unit, after the step (f).

BRIEF DESCRIPTION OF THE DRAWINGS

FIG. 11 is a table showing fault code groups activated/deactivated when an EOL test is performed.

Figure 1:
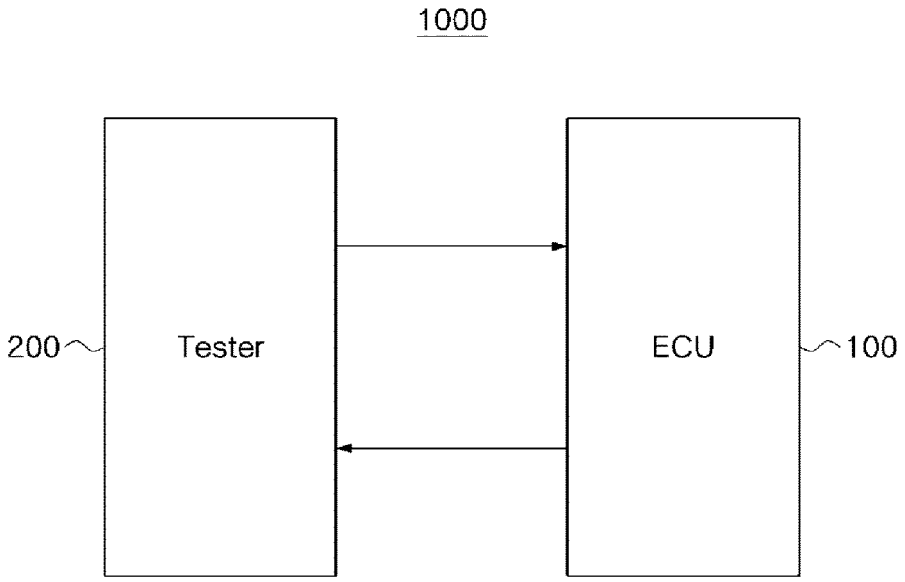
FIG. 1 is a diagram showing the configuration of a system for controlling, by an engine control unit, fault code in accordance with an embodiment of the present invention.

| <Description of reference numerals> | |
|---|---|
| 1000: system for controlling, by ECU, fault code | |
| 100: ECU | 10: fault code definition unit |
| 20: fault code control unit | |
| 21: fault code activation/deactivation unit | |
| 22: monitoring unit | 30: fault code storage unit |
| 40: fault code output unit | |
| 50: communication unit | |
| 200: tester | |

DETAILED DESCRIPTION

Hereinafter, some embodiments of the present invention are described in detail with reference to the exemplary drawings. The embodiments are provided so that those skilled in the art may easily understand the technical spirit of the present invention and the present invention is not restricted by the embodiments. A detailed description of the known functions and constructions will be omitted if it is deemed to make the gist of the present invention unnecessarily vague.

Furthermore, contents represented in the accompanying drawings have been diagrammed in order to easily describe the embodiments of the present invention, and the contents may be different from forms that are actually implemented. It is to be noted that in assigning reference numerals to elements in the drawings, the same reference numerals denote the same elements throughout the drawings even in cases where the elements are shown in different drawings Furthermore, it should be understood that an expression that some elements are "included" is an expression of an "open type" and the expression simply denotes that the corresponding elements are present, but does not exclude additional elements.

In the following specification, a system for controlling, by an ECU, fault code is described based on a case where an aging test is performed, but the present invention is not limited to the case. The present invention may be applied to several tests for performing a fault diagnosis function within a vehicle.

FIG. 1 is a diagram showing the configuration of a system 1000 for controlling, by an ECU, fault code in accordance with an embodiment of the present invention.

The system 1000 for controlling, by an engine control unit, fault code may include an ECU 100 and a tester 200. The ECU 100 is described below.

Figure 2:
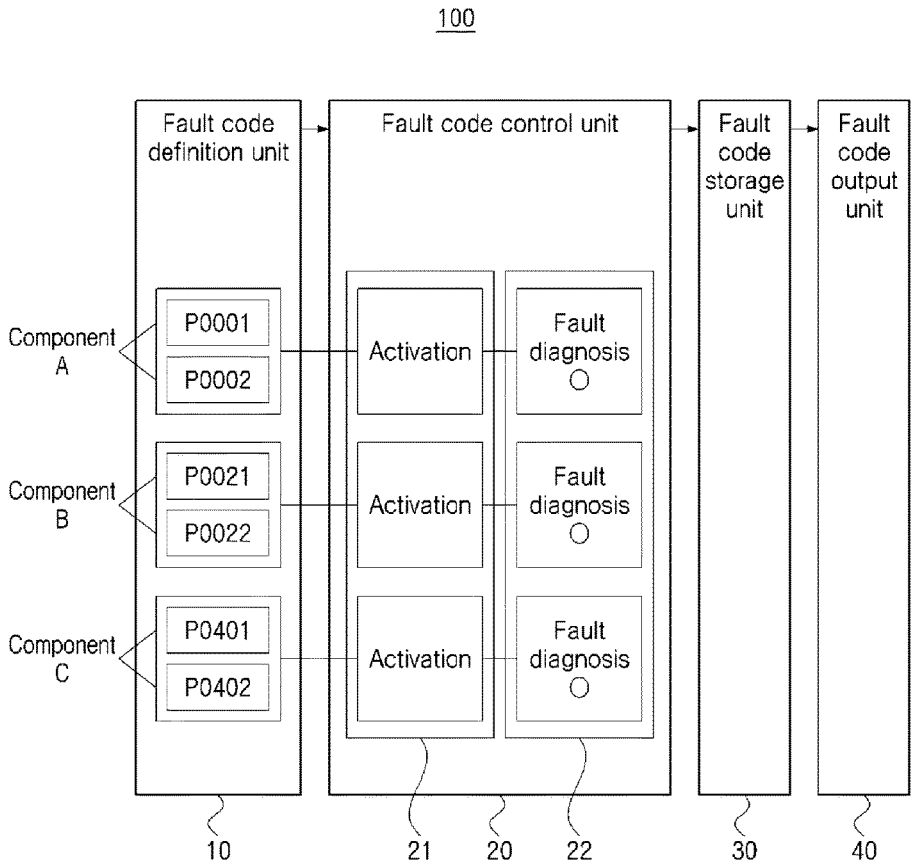
FIG. 2 is a diagram showing the configuration of an ECU in accordance with an embodiment of the present invention.

As shown in FIG. 2, the ECU 100 may include a fault code definition unit 10, a fault code control unit 20, a fault code storage unit 30, and a fault code output unit 40.

A variety of types of fault code have been defined in the fault code definition unit 10. The variety of types of fault code includes pieces of fault code defined according to various components of an engine or sensors for sending data to the engine. More specifically, the pieces of fault code are classified and defined as a plurality of groups. For example, as shown in FIG. 2, the pieces of fault code are classified and defined as a single group including pieces of fault code P0001 and P0002 for a component A, a single group including pieces of fault code P0021 and P0022 for a component B, and a single group including pieces of fault code P0401 and P0402 for a component C. The components may be configured according to each engine itself or each an actuator for driving the engine based on data transmitted by various sensors. Furthermore, in FIG. 2, the pieces of fault code have been illustrated as being classified into the three groups based on the components A to C, but may be classified into more groups depending on the number of components. For example, components having an association may be collected and classified as a large group. For example, if the components A and B have an association, the fault code group for the component A and the fault code group for the component B may be classified and defined as a single large group as indicated by dotted lines of FIGS. 3 to 9. In this case, the configuration of the group may be changed by only the designer of the ECU 100 and may not be randomly changed by a user for a reason related to safety.

The fault code definition unit 10 may perform a self-aging test in response to an aging test start command received from the tester 200 through the communication unit 50. That is, pieces of fault code have been defined as a plurality of groups according to components in the fault code definition unit 10, and the fault code definition unit 10 may perform an aging test for a fault diagnosis on the defined fault code. Accordingly, the fault code definition unit 10 may be considered to be a kind of a fault code diagnosis unit. Accordingly, a test program for performing the aging test or a test module may have been previously installed in the fault code definition unit 10. The fault code definition unit 10 performs the aging test only on fault code activated by the fault code control unit 20. This is described in detail in connection with the fault code control unit 20.

The fault code control unit 20 controls the activation/deactivation of the pieces of fault code defined in the fault code definition unit and monitors whether the aging test is performed. First, the fault code activation/deactivation unit 21 of the fault code control unit 20 which is responsible for the activation/deactivation of fault code is described below.

Figure 3:
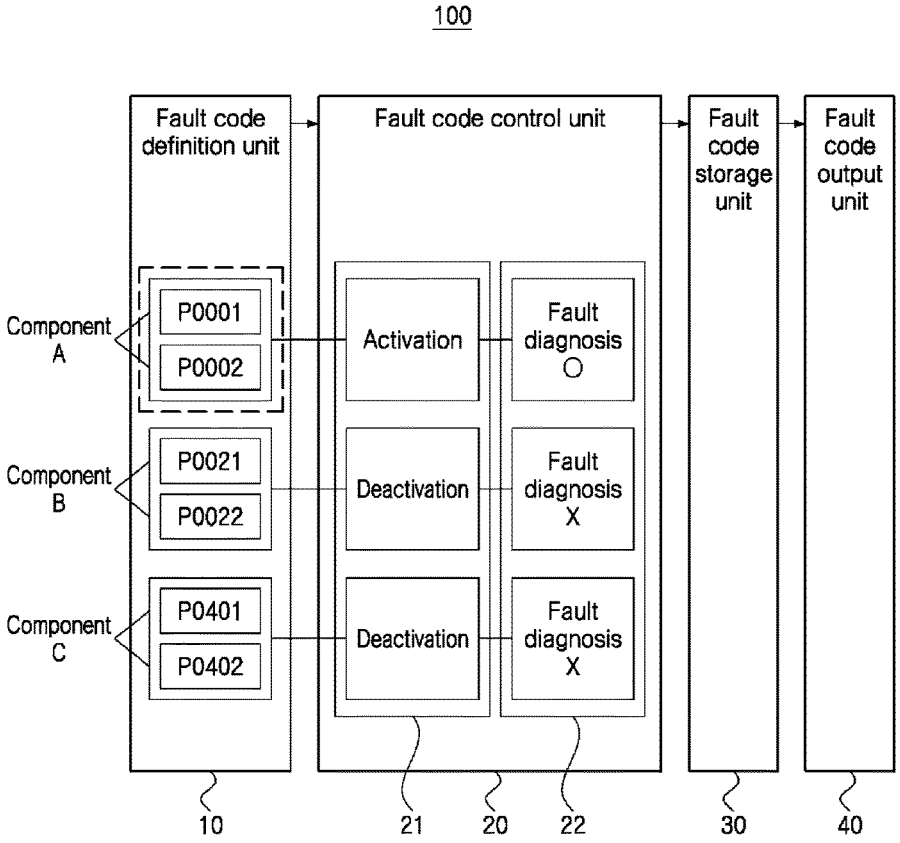
FIG. 3 is a diagram showing the state in which a fault code control unit activates a fault code group for one component and deactivates a fault code group for a plurality of remaining components.
Figure 4:
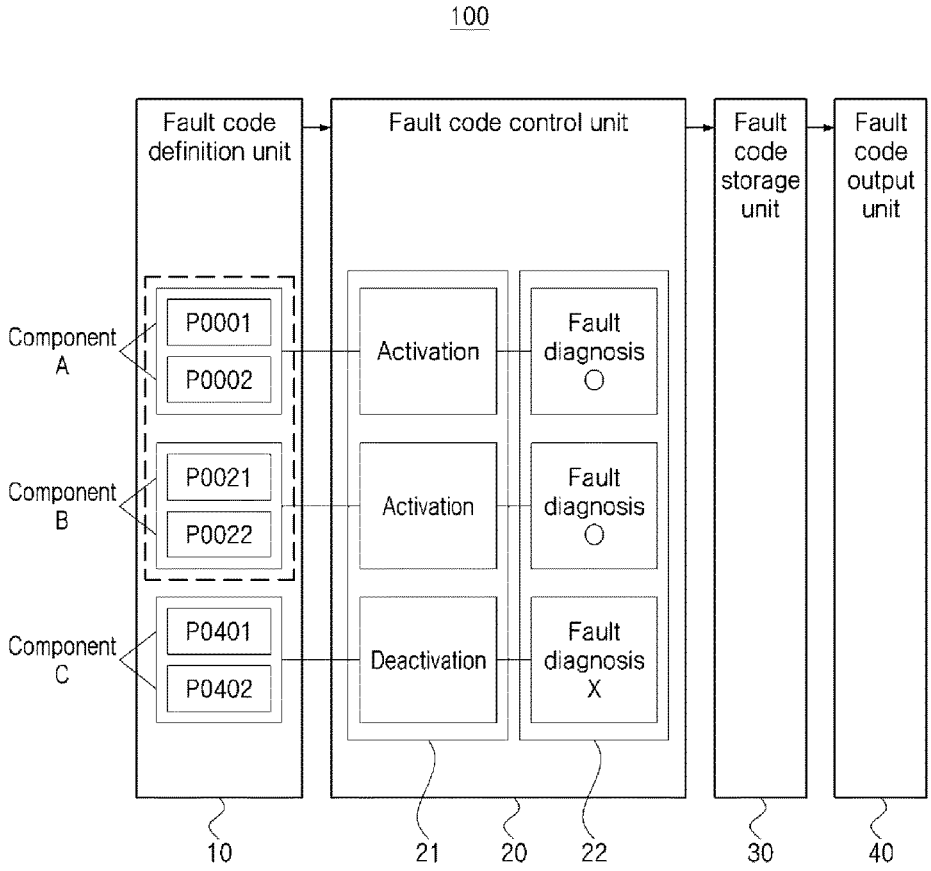
FIG. 4 is a diagram showing the state in which the fault code control unit activates a fault code group for a plurality of components and deactivates a fault code group and deactivates the remaining one component.

The fault code activation/deactivation unit 21 may activate one or more of a plurality of groups defined in the fault code definition unit 10 and deactivate the remaining groups. The activated one or more groups include a group in which fault code for a component which requires an aging test has been defined. The deactivated remaining groups include a group in which fault code for a component which does not require the aging test has been defined. For example, as shown in FIG. 3, if the aging test for the component A is required, only the group including the pieces of fault code P0001 and P0002 may be activated, and the fault code groups for the components B and C may be deactivated. If the fault code group is deactivated, only a component which requires the aging test may be tested because a fault diagnosis function for corresponding fault code is fully turned off. Furthermore, the fault code activation/deactivation unit 21 may activate one or more groups. Accordingly, if the aging test needs to be performed on the components A and B as shown in FIG. 4, the group including the pieces of fault code P0001 and P0002 and the group including the pieces of fault code P0021 and P0022 may be activated, and the fault code group for the component C may be deactivated. As described above, a fault code group for a component which requires an aging test is activated, and fault code groups for the remaining components are deactivated. Accordingly, the same effect as that the diagnosis function of an actuator, such as some input stages or some output stages, is turned off can be achieved. As a result, separate dedicated software for performing an aging test in which the diagnosis function of some actuators needs to be turned off does not need to be developed or installed.

The monitoring unit 22 of the fault code control unit 20 monitors an aging test on a plurality of activated/deactivated groups. More specifically, the monitoring unit 22 monitors whether fault code has been detected based on a result of an aging test on fault code which is included in a group activated by the fault code activation/deactivation unit 21. The interval of the monitoring may be freely set to about 10 ms or 100 ms by a designer. For example, as shown in FIG. 3, if an aging test needed to be performed on the component A and only the group including the pieces of fault code P0001 and P0002 has been activated, the monitoring unit 20 may check whether fault code has been detected by monitoring the group including the pieces of fault code P0001 and P0002 at a specific time interval. In this case, the monitoring unit 20 may monitor the groups including the deactivated components B and C, but the aging test is not performed because the groups have been deactivated. Accordingly, the monitoring unit 20 may not monitor deactivated groups.

The ECU 100 in accordance with an embodiment of the present invention may further include a communication unit 50. The communication unit 50 may communicate with the tester 200. More specifically, the communication unit 50 may receive a fault code activation/deactivation command from the tester 200 and send it to the fault code control unit 20. The fault code control unit 20 may control the activation/deactivation of a fault code group defined in the fault code definition unit 10 in response to the fault code activation/deactivation command. Furthermore, the communication unit 50 may receive an aging test start command from the tester 200 and send it to the fault code definition unit 10 so that an aging test is initiated. In this case, the communication unit 50 may communicate with the tester 200, the fault code definition unit 10, and the fault code control unit 20 in accordance with a controller area network (CAN) communication method. The CAN communication method is a commercialized communication method which is strong against many noises used in data transmission between control units within a vehicle and which has fast communication speed. In the CAN communication method, the activation/deactivation command is transmitted through two data lines called a CAN bus. That is, all of the communication unit 50 and the tester 200, the communication unit 50 and the fault code definition unit 10, and the communication unit 50 and the fault code control unit 20 are connected through the CAN bus. Furthermore, if the ECU 100 uses another commercialized communication method other than the CAN bus, the activation/deactivation command may be transmitted through other communication lines.

Figure 5:
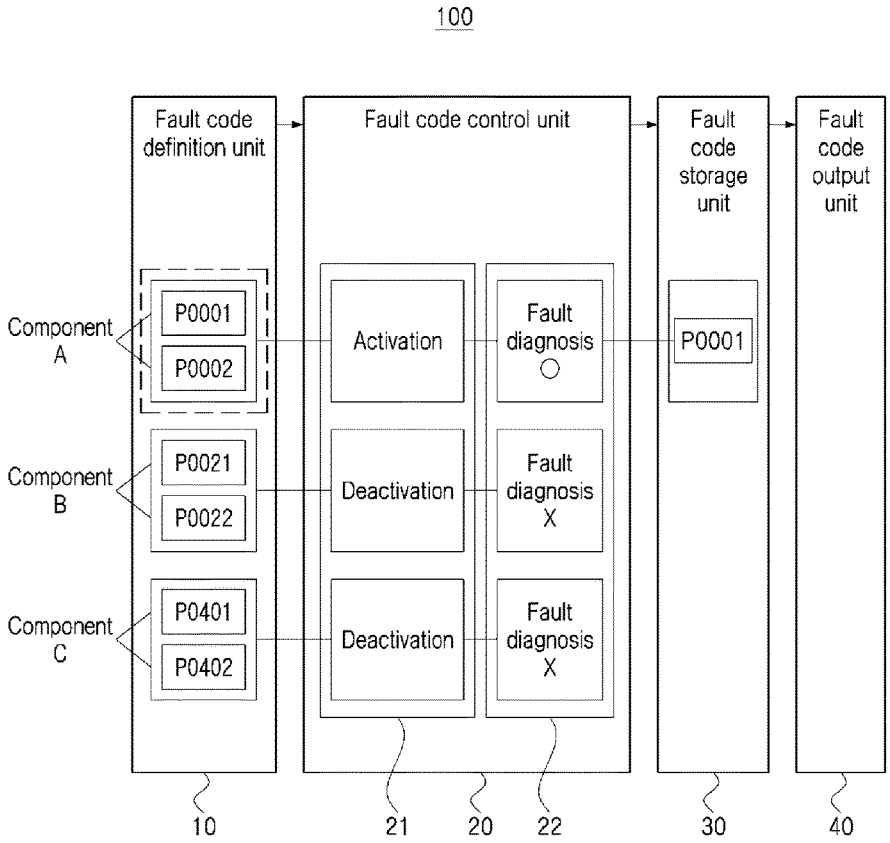
FIG. 5 is a diagram showing the state in which an aging test is performed on one component and thus detected fault code has been stored in a fault code storage unit.
Figure 6:
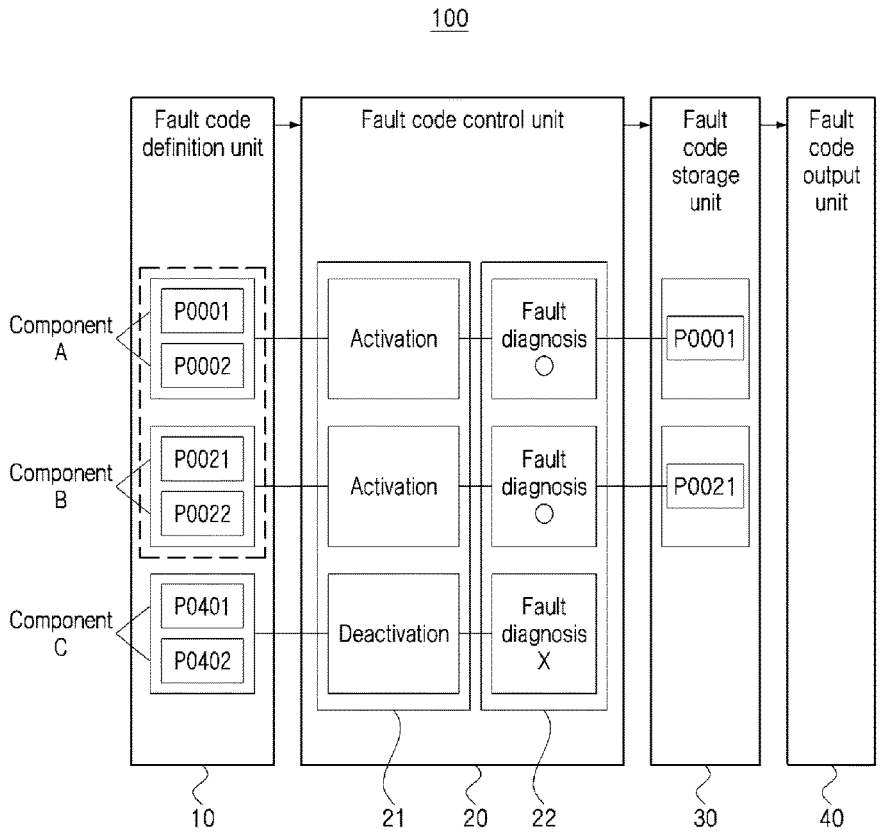
FIG. 6 is a diagram showing the state in which an aging test is performed on a plurality of components and thus detected fault code has been stored in the fault code storage unit by component.
Figure 7:
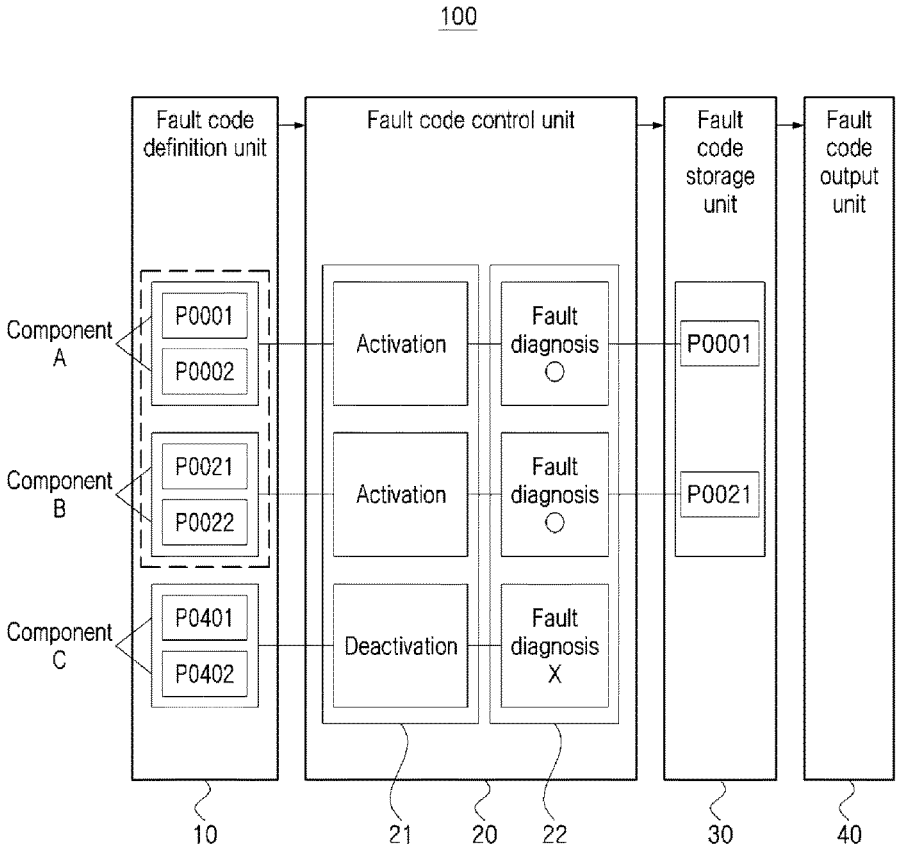
FIG. 7 is a diagram showing the state in which the fault code of FIG. 6 has been stored in the fault code storage unit without the classification of components.

The fault code storage unit 30 stores fault code detected as a result of an aging test performed by the fault code definition unit 10. In this case, if the aging test has been performed on one component, only fault code for the one component may be stored. If the aging test has been performed on a plurality of components, pieces of fault code for the plurality of components may be stored. For example, as shown in FIG. 3, if the aging test has been performed only on the component A and the fault code P0001 has been detected as a result of the aging test, only the fault code P0001 is stored in the fault code storage unit 30 as shown in FIG. 5. In contrast, as shown in FIG. 4, if the aging test has been performed on the components A and B and the pieces of fault code P0001 and P0021 have been detected as a result of the aging test, the pieces of fault code P0001 and P0021 are stored in the fault code storage unit 30 as shown in FIG. 6. Furthermore, if pieces of fault code for a plurality of components are detected, the pieces of detected fault code may be stored in the fault code storage unit 30 by component, but may be stored regardless of the components. For example, in the case of FIG. 6, the fault code P0001,detected for the component A and the fault code P0021 detected for the component B may be classified by component and stored or may be together stored as shown in FIG. 7. If pieces of fault code are classified by component and stored in the fault code storage unit 30, there is an advantage in that which component is defective can be easily checked when stored fault code is output. Accordingly, pieces of detected fault code may be classified by component and stored, for convenience sake. If fault code is detected by performing an aging test on only one component, however, all of pieces of detected fault code may be inevitably stored because the component is one.

Figure 8:
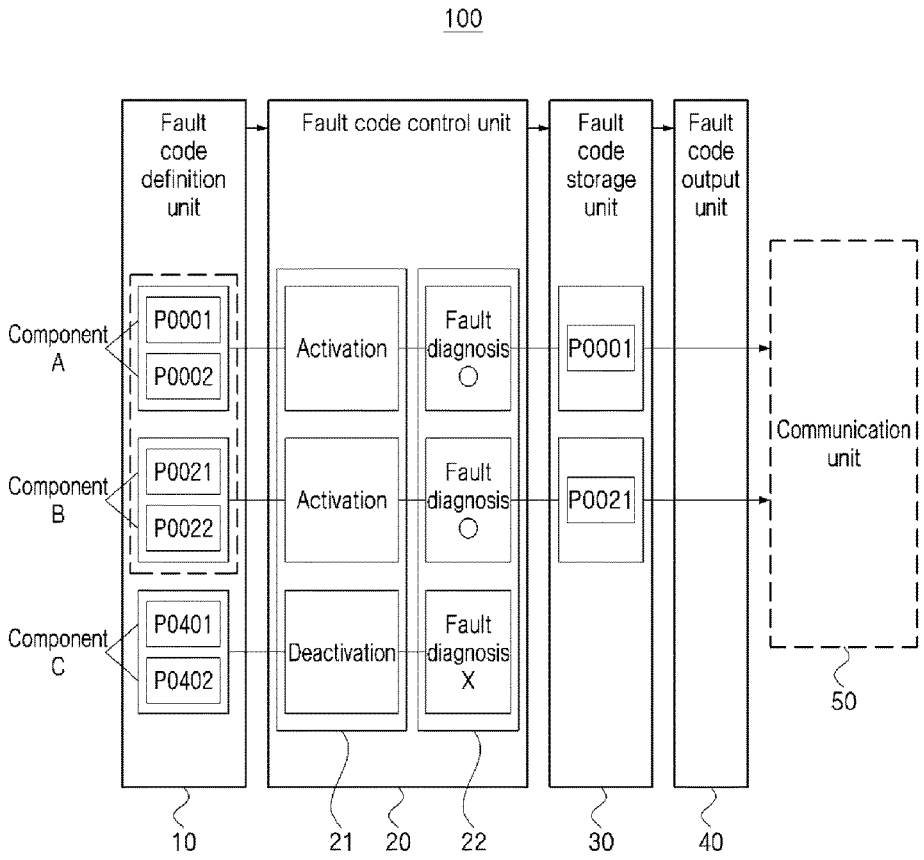
FIG. 8 is a diagram showing the state in which fault code stored in the fault code storage unit by component is output by component.
Figure 9:
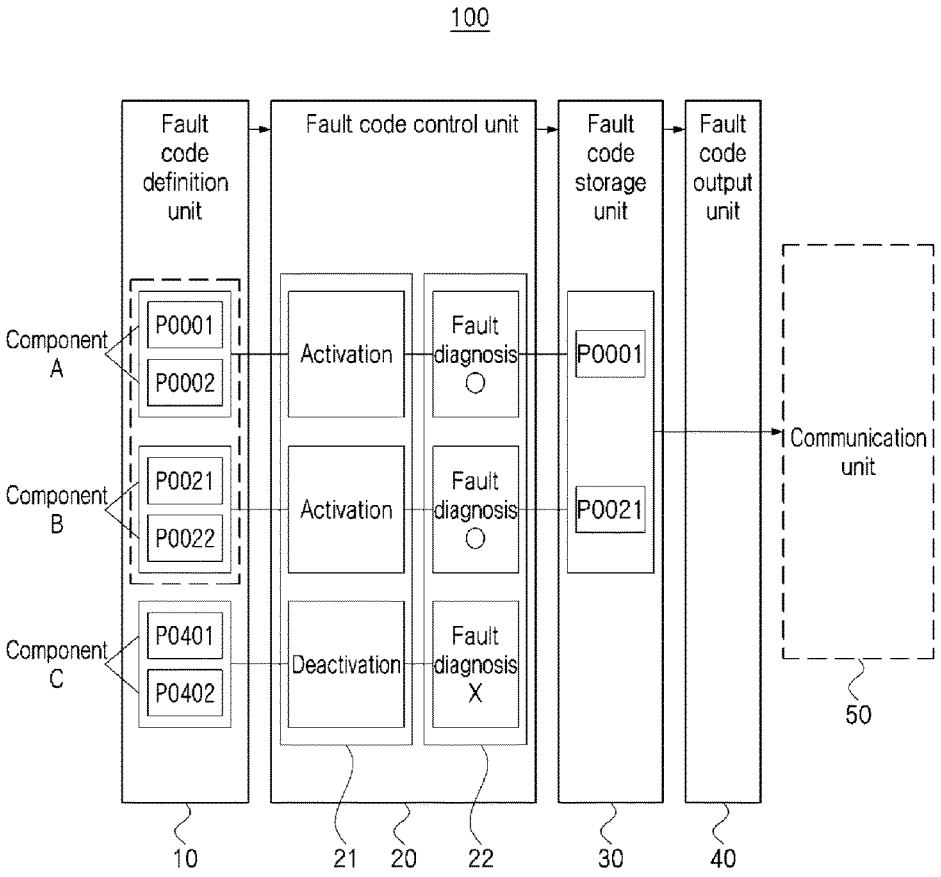
FIG. 9 is a diagram showing the state in which fault code stored in the fault code storage unit without the classification of components is output without a change.

The fault code output unit 40 outputs the fault code stored in the fault code storage unit 30. More specifically, when the communication unit 50 receives a fault code output command from the tester 200 and sends it to the fault code output unit 40, the fault code output unit 40 outputs corresponding fault code to the communication unit 50. The communication unit 50 sends the corresponding fault code to the tester 200. Such a process is also performed in accordance with the CAN communication method. If pieces of detected fault code are classified by component and stored in the fault code storage unit 30, the fault code output unit 40 may output the detected fault code by component as shown in FIG. 8. If the pieces of detected fault code are together stored regardless of the components, the fault code output unit 40 may output the detected fault code without a change as shown in FIG. 9.

The tester 200 sends an activation/deactivation command and an aging test start command to one or more groups for pieces of fault code defined in the fault code definition unit 10 of the ECU 100. That is, the tester 200 sends various commands to the fault code control unit 20 for controlling a fault code group, the fault code output unit 40 for outputting fault code, and the fault code definition unit 10 for performing the aging test through the communication unit 50. For example, right after the aging test is performed, the tester 200 may send a deactivation command for a fault code group for a component which does not require an aging test to the fault code control unit 20 through the communication unit 50. After sending the deactivation command, the tester 200 may send an aging test start command to the fault code definition unit 10 through the communication unit 50. Furthermore, after the aging test is performed, the tester 200 may send an output command for detected fault code to the fault code output unit 40 through the communication unit 50. Furthermore, when the fault code output unit 40 sends detected fault code to the tester 200 through the communication unit 50, the tester 200 sends an activation command to the fault code control unit 20 through the communication unit 50 with respect to a fault code group for a component for which a deactivation command has been first transmitted. Accordingly, the diagnosis function of all the components can be turned on.

If the tester 200 has a function of sending the fault code activation/deactivation commands, the aging test start command, and the fault code output command to the ECU 100, a known aging tester using the CAN communication method may be used. In an existing aging tester, after dedicated software is developed and installed in the ECU 100, an aging test is performed. Accordingly, in order for the existing aging tester to have a function of sending the fault code activation/deactivation commands, the aging test start command, and the fault code output command to the ECU 100, a test program installed in the existing aging tester needs to be newly designed.

In accordance with the system 1000 including the ECU 100 and the tester 200, a deactivation command is transmitted to a fault code group for a component which does not require an aging test, and an aging test may be performed on only a component which requires the aging test. Accordingly, there is no need for the fabrication and installation of dedicated software for an aging test which may be performed only when a fault diagnosis function for some components is prohibited. Furthermore, a process for newly reprogramming an engine control program after an aging test is not required. Accordingly, the fabrication period of a vehicle can be reduced, efficiency of production can be improved, the process can be simplified, and a probability that an error may occur in an additional reprogramming process can be significantly reduced.

The system 1000 for controlling, by an ECU, fault code in accordance with an embodiment of the present invention may be implemented in the form of a method for controlling, by an ECU, fault code, which has a different category, but has substantially the same characteristics. The method is described below with reference to FIG. 10.

Figure 10:
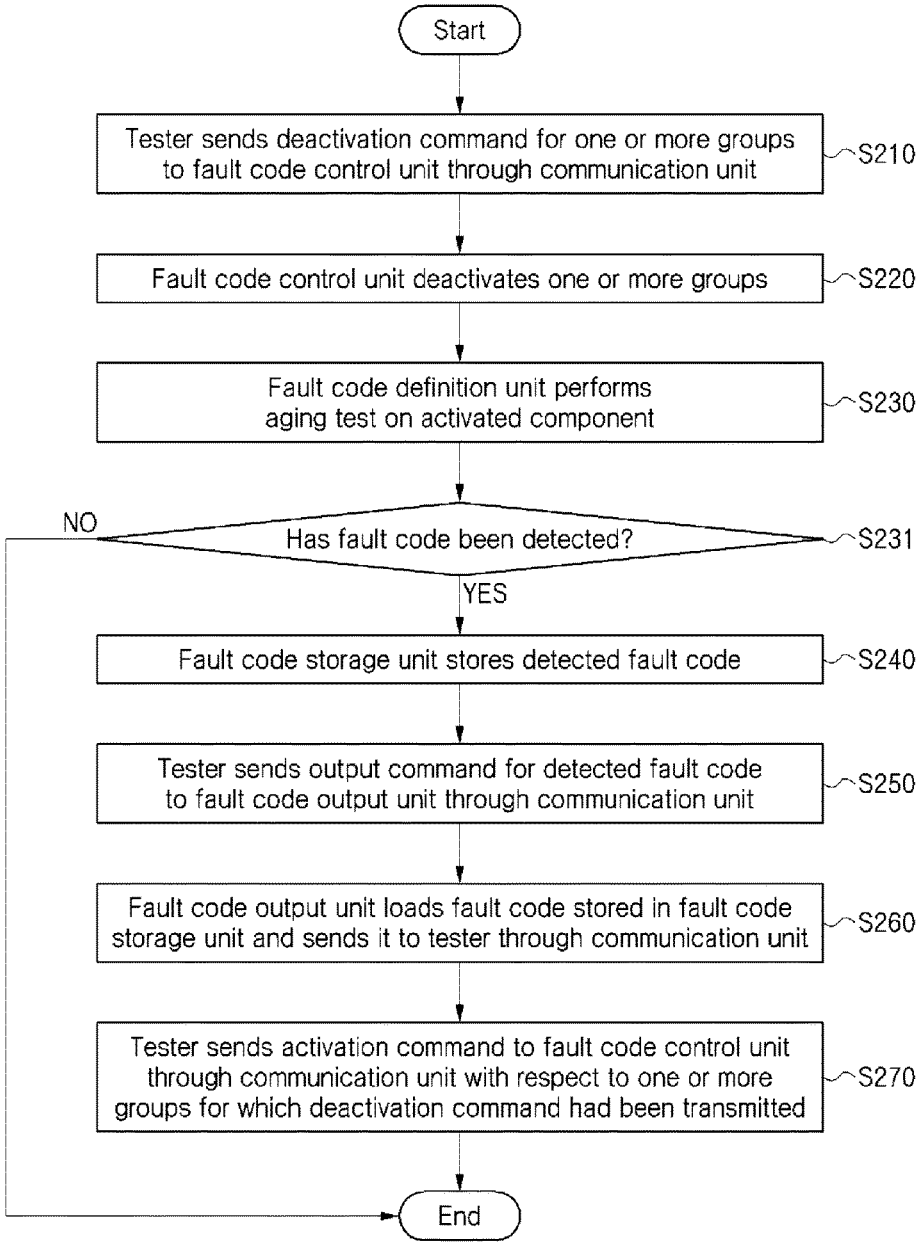
FIG. 10 is a flowchart illustrating a method for controlling, by an ECU, fault code in accordance with an embodiment of the present invention.

FIG. 10 is a flowchart illustrating a method for controlling, by an ECU, fault code in accordance with an embodiment of the present invention. The flowchart is only a sequential flowchart illustrated to achieve the most preferred results in implementing an embodiment of the present invention. It is to be noted that additional steps may be provided to the flowchart or some steps may be deleted from the flowchart. Furthermore, it is assumed that pieces of fault code have been classified according to the components of an engine or sensors for sending data to the engine and stored in the ECU 100 as a plurality of groups as described above.

First, the tester 200 sends a deactivation command for one or more groups to the fault code control unit 20 through the communication unit 50 at step S210. The fault code control unit 20 deactivates the one or more groups at step S220. In this case, the group, that is, the subject of the transmission of the deactivation command, includes a group in which fault code for a component which does not require an aging test has been defined. The fault diagnosis function of some components can be prohibited in response to the deactivation command. For example, as shown in FIG. 3, if an aging test needs to be performed on the component A, the fault code groups for the components B and C may be deactivated. As shown in FIG. 4, if an aging test needs to be performed on the components A and B, the fault code group for the component C may be deactivated. In this case, the monitoring unit 22 may perform monitoring on activated groups at a specific time interval.

The deactivation command may be transmitted through the CAN communication method. If the ECU 100 uses another commercialized communication method, the activation/deactivation commands may be transmitted using other communication lines. This may be applied to all of step S230 to step S270.

When the one or more groups, that is, the subject of the deactivation command, are deactivated, the fault code definition unit 10 performs an aging test on an activated component at step S230. If, as a result of the execution of the aging test, fault code is detected at step S231, the fault code storage unit 30 stores the detected fault code at step S240. In this case, if the tester 200 has a function of sending fault code activation/deactivation commands, an aging test start command, and a fault code output command to the ECU 100, a known aging tester using the CAN communication method may be used. In an existing aging tester, after dedicated software is developed and installed in the ECU 100, an aging test is performed. Accordingly, in order for the existing aging tester to have the function of sending the fault code activation/deactivation commands, the aging test start command, and the fault code output command to the ECU 100, a test program installed in the existing aging tester needs to be newly designed. If an aging test has been performed on fault code stored in the fault code storage unit 30 with respect to only one component, only the fault code for the corresponding component is stored. If an aging test has been performed on a plurality of components, fault code for all the plurality of components may be stored. For example, as shown in FIG. 3, if an aging test has been performed on only the component A and the fault code P0001 has been detected as a result of the aging test, only the fault code P0001 is stored in the fault code storage unit 30, as shown in FIG. 5. In contrast, as shown in FIG. 4, if an aging test has been performed on the components A and B and the pieces of fault code P0001 and P0021 have been detected as a result of the aging test, the pieces of fault code P0001 and P0021 are stored in the fault code storage unit 30, as shown in FIG. 6. Furthermore, if fault code for a plurality of components has been detected, detected fault code may be stored in the fault code storage unit 30 by component, but may be stored regardless of the components. For example, the fault code P0001 detected for the component A and the fault code P0021 detected for the component B may be classified by component and stored as shown in FIG. 6 or may be stored together as shown in FIG. 7.

When the detected fault code is stored in the fault code storage unit 30, the tester 200 sends an output command for the detected fault code to the fault code output unit 40 through the communication unit 50 at step S250. The fault code output unit 40 loads the fault code stored in the fault code storage unit 30 and sends it to the tester 200 through the communication unit 50 at step S260. If pieces of detected fault code have been classified by component and stored, the fault code output unit 40 may output the pieces of detected fault code to the fault code storage unit 30 by component as shown in FIG. 8. If the pieces of detected fault code have been stored together regardless of the components, the fault code output unit 40 may output the pieces of detected fault code without a change as shown in FIG. 9.

At step S270, the tester 200 sends an activation command to the fault code control unit 20 through the communication unit 50 with respect to the one or more groups for which the deactivation command had been transmitted at step S210. The diagnosis function of all the components may be turned on in response to the activation command. Accordingly, a corresponding vehicle can directly return to the state in which the vehicle can be released without a need to newly reprogramming its engine control program.

The method for controlling, by an ECU, fault code may be implemented in the form of a program which may be stored in a recording medium to be executed in the ECU 100 or may be implemented in the form of a recording medium which may be read in the ECU 100 in which a program to be executed in the ECU 100 has been written. Furthermore, the system 1000 for controlling, by an ECU, fault code and the method for controlling, by an ECU, fault code have been described based on an aging test for fault code regarding all ECU, but may be applied to all tests related to fault code, which are performed within a vehicle. For example, the system 1000 and the method may be applied to an EOL test. Referring to FIG. 11, an EOL test may be performed in the state in which groups 3 and 4 related to a solenoid are activated and the remaining groups 1, 2, 5, and 6 are deactivated. That is, a technical spirit in which a test is performed by activating a group including fault code related to a component to be tested and deactivating the remaining groups may be identically applied to components other than an ECU.

In accordance with an embodiment of the present invention, there is an advantage in that an aging test can be conveniently performed because the fabrication and installation of dedicated software for performing the aging test are not required.

Furthermore, an additional reprogramming process is not required after an aging test. Accordingly, the fabrication period of a vehicle can be reduced, efficiency of production can be improved, the process can be simplified, and a probability that an error may occur in an additional reprogramming process can be significantly reduced.

Technical advantages of the present invention are not limited to the aforementioned advantages, and they may include various other advantages within a range evident to those skilled in the art from the aforementioned description.

The aforementioned embodiments of the present invention have been disclosed for illustrative purposes, and the present invention is not restricted by the embodiments. Furthermore, those skilled in the art to which the present invention pertains may modify and change the present invention in various ways within the spirit and scope of the present invention, and such modifications and changes should be construed as belonging to the scope of the present invention.

What is claimed is:

1. An engine control unit (ECU), comprising:

a fault code definition unit configured to have at least a fault code defined in the fault code definition unit;

a fault code control unit configured to control an activation/deactivation of the at least a fault code defined in the fault code definition unit;

a fault code storage unit configured to store at least a fault code detected by performing a test; and a fault code output unit configured to output the at least a fault code stored in the fault code storage unit, wherein the at least a fault code defined in the fault code definition unit is classified according to components of an engine or sensors for sending data to the engine and defined in the fault code definition unit as a plurality of single groups according to the components or as at least a large group, wherein each single group includes at least two pieces of fault codes and each large group includes at least two single groups, and wherein the fault code control unit comprises a fault code activation/deactivation unit configured to activate one of the plurality of single groups or the at least a large group defined in the fault code definition unit and to deactivate remaining single and large groups, wherein the at least a fault code defined in the fault code definition unit includes a fault code for a component which is related to the test and the single groups or the at least a large group activated by the fault code activation/deactivation unit comprise groups in which the fault code for the component which is related to the test has been predefined before the test, wherein the fault code control unit controls activation and deactivation of the plurality of single groups or the at least a large group in a response to a fault code activation/deactivation command of a tester, and wherein the fault code definition unit performs the test for the activated group when the fault code control unit receives the fault code activation/deactivation command of the tester, wherein the fault code control unit further comprises a monitoring unit configured to monitor whether the at least a fault code has been detected based on a result of the test in the single groups or the at least a large group activated by the fault code activation/deactivation unit at a predetermined time interval, and wherein the remaining single or large groups deactivated by the fault code activation/deactivation unit comprise groups in which the fault code for the component which is not related to the test has been predefined before the test.

2. The engine control unit of claim 1, wherein the engine control unit comprises a communication unit configured to thereby communicate with the tester.

3. The engine control unit of claim 2, wherein the communication unit receives the fault code activation/deactivation command from the tester and sends the fault code activation/deactivation command to the fault code control unit.

4. The engine control unit of claim 2, wherein the communication unit receives the fault code output command from the tester and sends the fault code output command to the fault code output unit.

* * * * *